US012788168B2

(12) United States Patent
Tarratt et al.

(10) Patent No.: US 12,788,168 B2
(45) Date of Patent: Nov. 10, 2026

(54) SEPARABLE OBJECT HOLDER

(71) Applicant: Urban Diggers Pty Ltd, The Caves (AU)

(72) Inventors: Kristy Anne Tarratt, The Caves (AU); Scott Edward Tarratt, The Caves (AU)

(73) Assignee: Urban Diggers Pty Ltd, The Caves (AU)

( * ) Notice: Subject to any disclaimer, the term of this patent is extended or adjusted under 35 U.S.C. 154(b) by 210 days.

(21) Appl. No.: 18/764,494

(22) Filed: Jul. 5, 2024

(65) Prior Publication Data

US 2025/0009156 A1 Jan. 9, 2025

(30) Foreign Application Priority Data

Jul. 6, 2023 (AU) ..... 2023902174

(51) Int. Cl.
*A47G 23/02* (2006.01)

(52) U.S. Cl.
CPC .... *A47G 23/0225* (2013.01); *A47G 2200/106* (2013.01)

(58) Field of Classification Search
CPC ..... A47G 23/0225; A47G 2200/106
USPC ..... 220/737
See application file for complete search history.

(56) References Cited

U.S. PATENT DOCUMENTS

| | | | | |
|---|---|---|---|---|
| 3,524,614 | A * | 8/1970 | Sorth | A47G 23/0225 248/500 |
| 10,292,514 | B1 * | 5/2019 | Kuhn | B60N 3/103 |
| 12,318,025 | B2 * | 6/2025 | Cooper | F25D 3/08 |
| 2011/0132907 | A1 * | 6/2011 | Hajichristou | B65D 43/0225 215/337 |
| 2019/0225388 | A1 * | 7/2019 | Wasso, Jr. | B65D 51/24 |
| 2019/0357713 | A1 * | 11/2019 | Zimmer | A47G 19/2205 |
| 2020/0002054 | A1 * | 1/2020 | Gronkowski | B65D 81/3205 |
| 2020/0140168 | A1 * | 5/2020 | Chiang | A45F 5/02 |
| 2020/0352374 | A1 * | 11/2020 | Ferraro | A47G 19/2261 |
| 2022/0277875 | A1 * | 9/2022 | Lamoureux | B60N 3/102 |
| 2022/0322858 | A1 * | 10/2022 | Macsherry | A47G 23/0225 |

* cited by examiner

*Primary Examiner* — Orlando E Aviles
*Assistant Examiner* — Niki M Eloshway
(74) *Attorney, Agent, or Firm* — Boyle Fredrickson S.C.

(57) ABSTRACT

A separable object holder including a base assembly including a base body having a first surface, a second surface configured to attach to a surface, and a base magnet located in the base body, and a mounting assembly including a mounting body having a first surface configured to attach to an object and a second surface configured to abut the first surface of the base assembly, and a mounting assembly magnet located therein. The base magnet and the mounting assembly magnet are configured such that the mounting assembly magnet magnetically repels the base magnet when either the mounting assembly or base assembly is rotated relative to the other of the mounting assembly or base assembly to separate the base assembly from the mounting assembly.

17 Claims, 9 Drawing Sheets

SEPARABLE OBJECT HOLDER

CROSS-REFERENCE TO RELATED APPLICATION

The present invention claims priory to Australia Patent Application No. AU 2023902174, filed on Jul. 6, 2023, the entire contends of which are incorporated herein.

TECHNICAL FIELD

The present invention relates to a separable object holder for holding an object in a fixed position relative to a base assembly.

BACKGROUND

Any references to methods, apparatus or documents of the prior art are not to be taken as constituting any evidence or admission that they formed, or form part of the common general knowledge.

Retaining an object (such as personal electronic devices, cups and travel mugs) in a desired orientation and location is often difficult and complicated to manage in a wide range of scenarios.

There are devices for holding objects and retaining them in an upright or desired orientation but these are often difficult to use or allow the device too much freedom of movement such that they do not satisfactorily achieve their intended purpose.

Some magnetically engaging devices use neodymium magnets that provide strong engagement which can be difficult to disengage without excessive force. In some cases, such as with cup or beverage holders, this can result in the beverage being spilled.

Thus, there is a need for an improved separable object holder.

SUMMARY OF INVENTION

In an aspect, the invention provides a separable object holder comprising:

a base assembly including a base body having a first surface, a second surface configured to attach to a surface, and a base magnet located in the base body; and a mounting assembly including a mounting body having a first surface configured to attach to an object and a second surface configured to abut the first surface of the base assembly, and a mounting assembly magnet located therein, wherein, in a united configuration, the base magnet and the mounting assembly magnet are configured such that the mounting assembly magnet magnetically repels the base magnet when either the mounting assembly or base assembly is rotated relative to the other of the mounting assembly or base assembly by up to approximately 90°.

Preferably, a face of each of the base magnet and the mounting assembly magnet is configured with a polarity pattern including alternating polarity portions about face of the respective magnet to allow the mounting assembly magnet to magnetically attract the base magnet to hold the mounting assembly in a fixed position relative to the base assembly.

Preferably, a face of each of the base magnet and the mounting assembly is configured with a polarity pattern enabling magnetic attraction between the face of the base magnet in direct opposition with the face of the mounting assembly magnet when either of the base magnet or the mounting assembly magnet is rotated between 0 and 90 degrees about an axis extending through a centre of both the mounting assembly magnet and the base magnet to hold the mounting assembly in a fixed position relative to the base assembly.

More preferably, a face of each of the base magnet and the mounting assembly is configured with a polarity pattern enabling magnetic repulsion between the face of the base magnet in direct opposition with the face of the mounting assembly magnet when the first surface of the base assembly is in abutment with the second surface of the mounting assembly (i.e., the united configuration) and either of the base magnet or the mounting assembly magnet is rotated approximately 90 degrees about an axis extending through a centre of both the mounting assembly magnet and the base magnet to thereby separate the mounting assembly from the base assembly.

Preferably, the base magnet and the mounting assembly magnet are programmable magnets.

Preferably, the base assembly includes an alignment arrangement for assisting with aligning the mounting assembly with the base assembly to induce magnetic engagement between the respective mounting assembly magnet and base magnet. Preferably, the alignment arrangement includes a plurality of projections connected to a surface of the base assembly between the first surface and the second surface, wherein the projecting elements extend beyond the first surface in a direction parallel to a longitudinal axis of the base assembly. Preferably, the base assembly includes a plurality of projecting elements connected to the base assembly. The plurality of projecting elements may be connected to and project from the first surface of the base assembly.

In one embodiment, the polarity pattern of the base magnet comprises a first polarity pattern and a second polarity pattern, wherein the first polarity pattern is substantially annular and the second polarity pattern is substantially circular and is surrounded by the first polarity pattern. Preferably, the first polarity pattern comprises four substantially equal sub-portions arranged in an alternating polarity sequence. Preferably, the second polarity pattern comprises four quadrants arranged in an alternating polarity sequence, wherein a polarity of a sub-portion of the annular first polarity pattern is adjacent a quadrant of the circular second polarity pattern having an opposite polarity. Preferably, the polarity of each quadrant is predominantly a first polarity and may include a second polarity with one predominant polarity from the first and second polarities.

Preferably, the base magnet comprises a substantially annular portion and a circular portion surrounded by the annular portion. Preferably, the annular portion comprises four substantially equal sub-portions, wherein each of the sub-portions has a polarity opposite to an adjacent sub-portion of the annular portion. Preferably, the circular portion comprises four quadrants, wherein each of the quadrants is predominantly a first polarity (but may include a second polarity with one predominant polarity from the first and second polarities) and wherein each of the quadrants has a polarity opposite to an adjacent sub-portion of the annular portion where the quadrant meets the sub-portion.

In another aspect, the invention provides a method of securing an object with a separable object holder, the method comprising:

providing a base assembly including a base body having a first surface, a second surface configured to attach to a surface, and a base magnet located in the base body;

providing a mounting assembly including a mounting body having a first surface configured to attach to an object and a second surface configured to abut the first surface of the base assembly, and a mounting assembly magnet located therein;

attaching the second surface of the base assembly to a surface;

attaching an object to the first surface of the mounting assembly;

magnetically engaging the mounting assembly magnet with the base magnet such that the mounting assembly magnet is magnetically attracting the base magnet to hold the mounting assembly in a fixed position relative to the base assembly to configure the base assembly and the mounting assembly in a united configuration; and rotating either the mounting assembly or base assembly relative to the other of the mounting assembly or base assembly by up to approximately 90° to magnetically repel the mounting assembly magnet away from the base magnet and separate the mounting assembly from the base assembly.

Preferably, a face of each of the base magnet and the mounting assembly being configured with a polarity pattern enabling magnetic engagement between the face of the base magnet in direct opposition with the face of the mounting assembly magnet when either of the base magnet or the mounting assembly magnet is rotated between 0 and 90 degrees about an axis extending through a centre of both the mounting assembly magnet and the base magnet when to hold the mounting assembly in a fixed position relative to the base assembly;

and the method further comprises:

arranging the face of the mounting assembly magnet in direct opposition with the base magnet; and rotating the mounting assembly or the base assembly between 0 and 90 degrees about the axis extending through the centre of both the mounting assembly magnet and the base magnet to magnetically engage the mounting assembly magnet with the base magnet to hold the mounting assembly in a fixed position relative to the base assembly.

Preferably, a face of each of the base magnet and the mounting assembly magnet is configured with a polarity pattern including alternating polarity portions about an edge of the respective magnet to allow the mounting assembly magnet to magnetically engage with the base magnet to hold the mounting assembly in a fixed position relative to the base assembly;

and the method further comprises:

arranging the face of the mounting assembly magnet in direct opposition with the base magnet; and magnetically engaging the mounting assembly magnet with the base magnet to hold the mounting assembly in a fixed position relative to the base assembly.

The mounting assembly magnet is configured the same as the base magnet as set out above.

In another aspect, the invention provides a pair of magnets including a first magnet and a second magnet, each magnet having a polarity pattern on a face, wherein, in a united configuration, each magnet is configured to magnetically repel the other magnet when either the first magnet or the second magnet is rotated relative to the other of the first magnet or second magnet by up to approximately 90°.

In an aspect, the invention provides a separable object holder comprising:

a base assembly including a base body having a first surface, a second surface configured to attach to a surface, and a base magnet located in the base body; and a mounting assembly including a mounting body having a first surface configured to attach to an object and a second surface configured to abut the first surface of the base assembly, and a mounting assembly magnet located therein, wherein the base magnet and the mounting assembly magnet are configured such that the mounting assembly magnet magnetically repels the base magnet when either the mounting assembly or base assembly is rotated relative to the other of the mounting assembly or base assembly to separate the base assembly from the mounting assembly.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
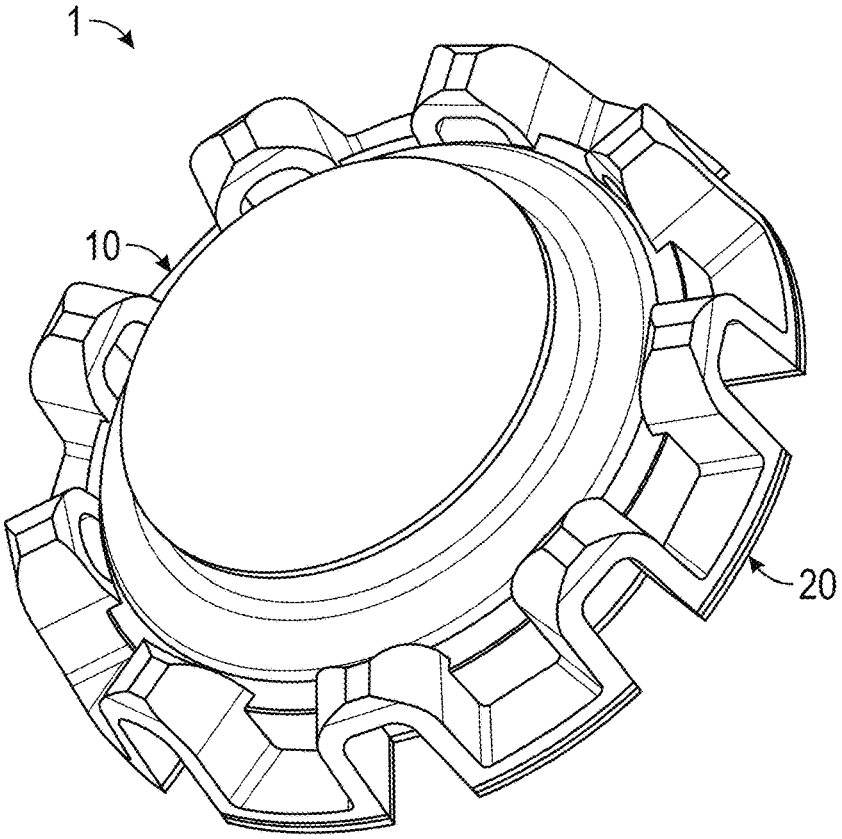
FIG. 1 illustrates a separable object holder in a united configuration according to an embodiment of the present invention.
Figure 2:
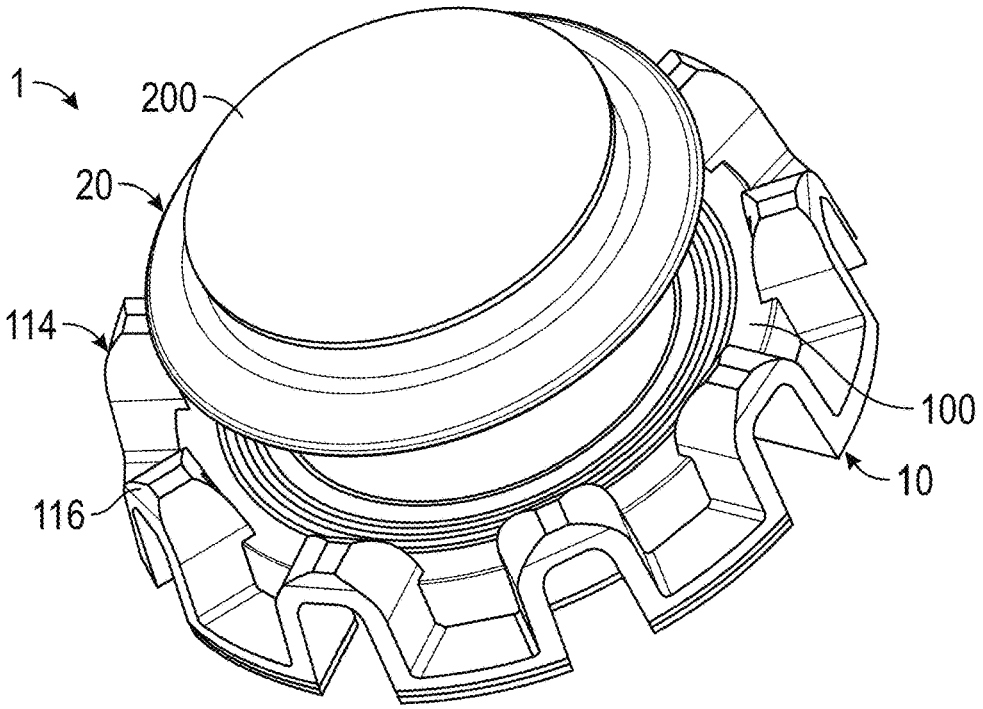
FIG. 2 illustrates the separable object holder in a separated configuration.
Figure 3:
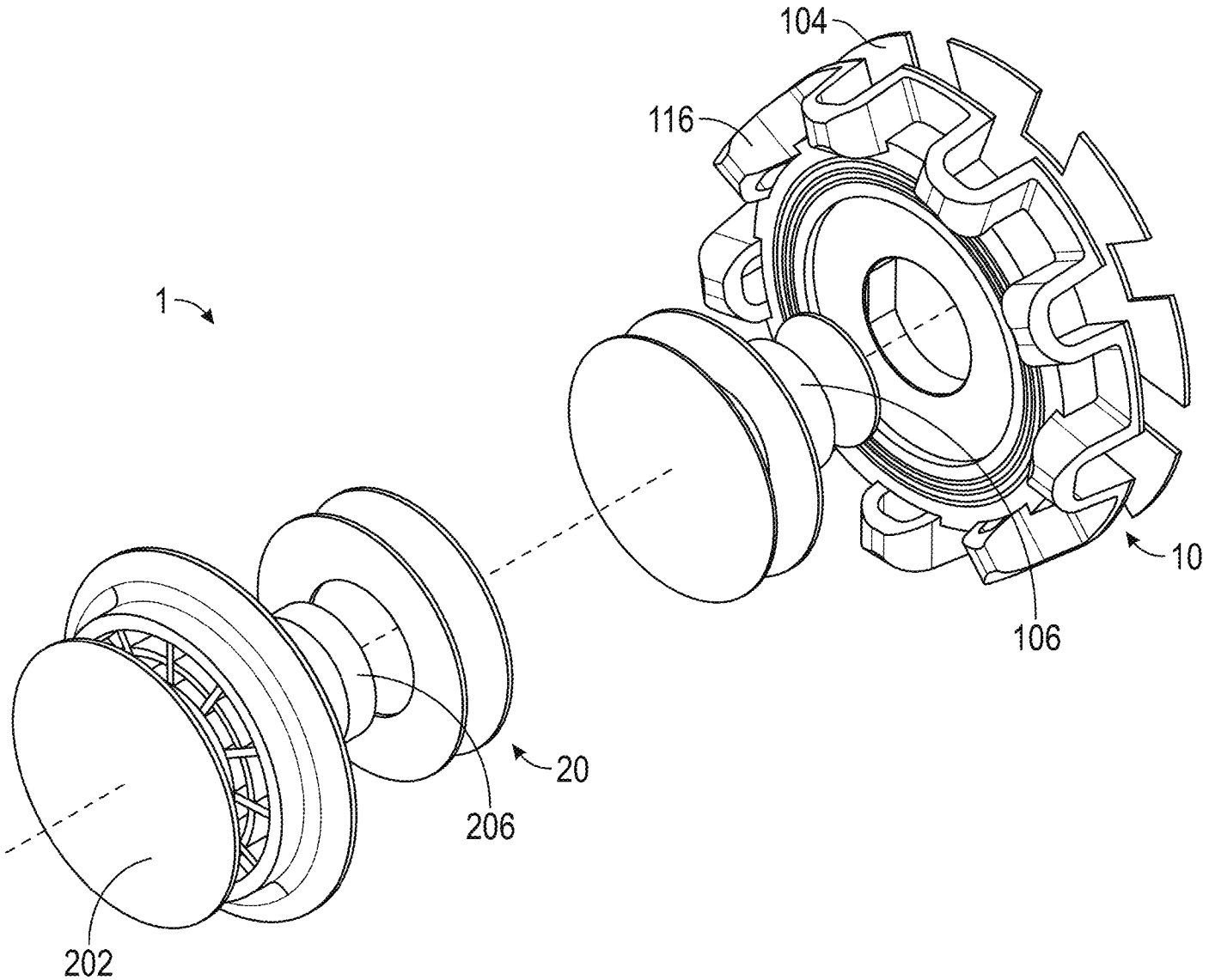
FIGS. 3 and 4 are exploded views of the separable object holder.
Figure 4:
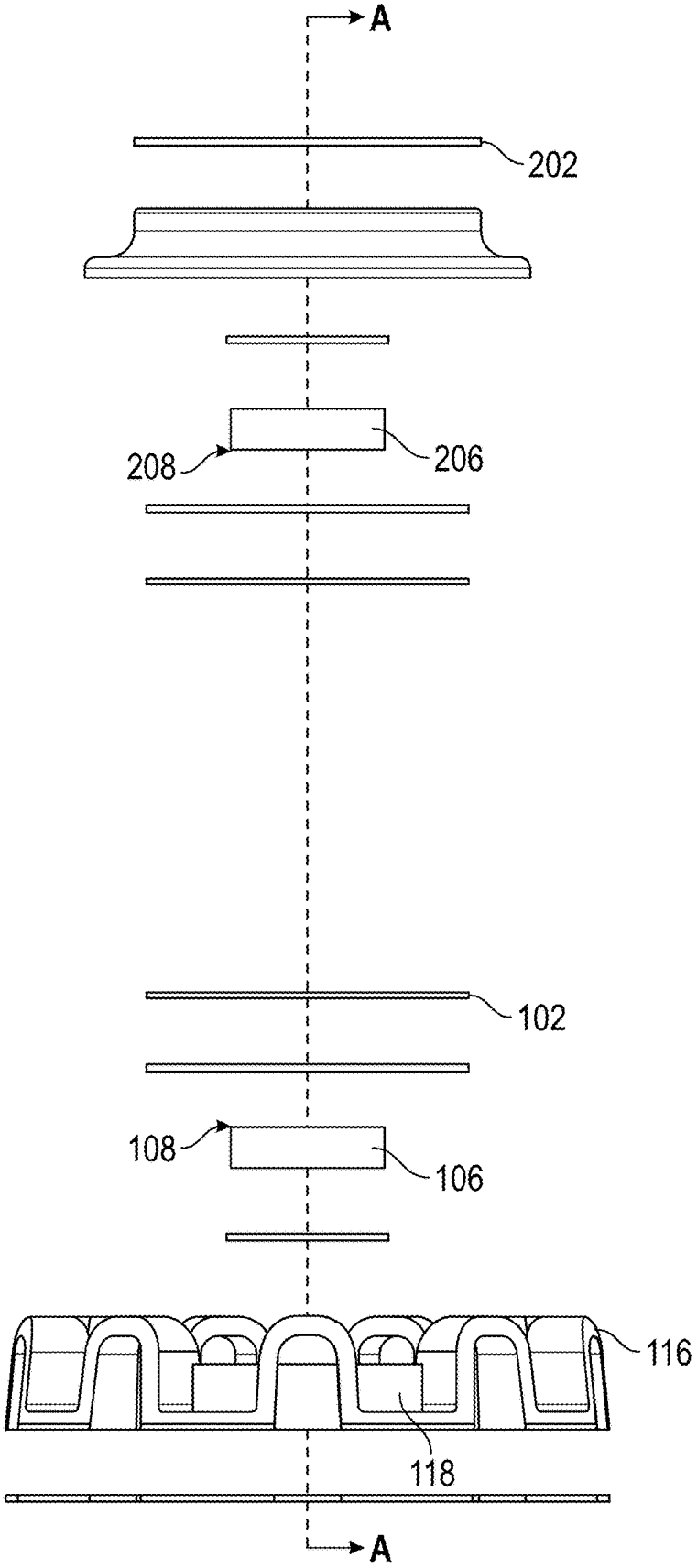
Figure 5:
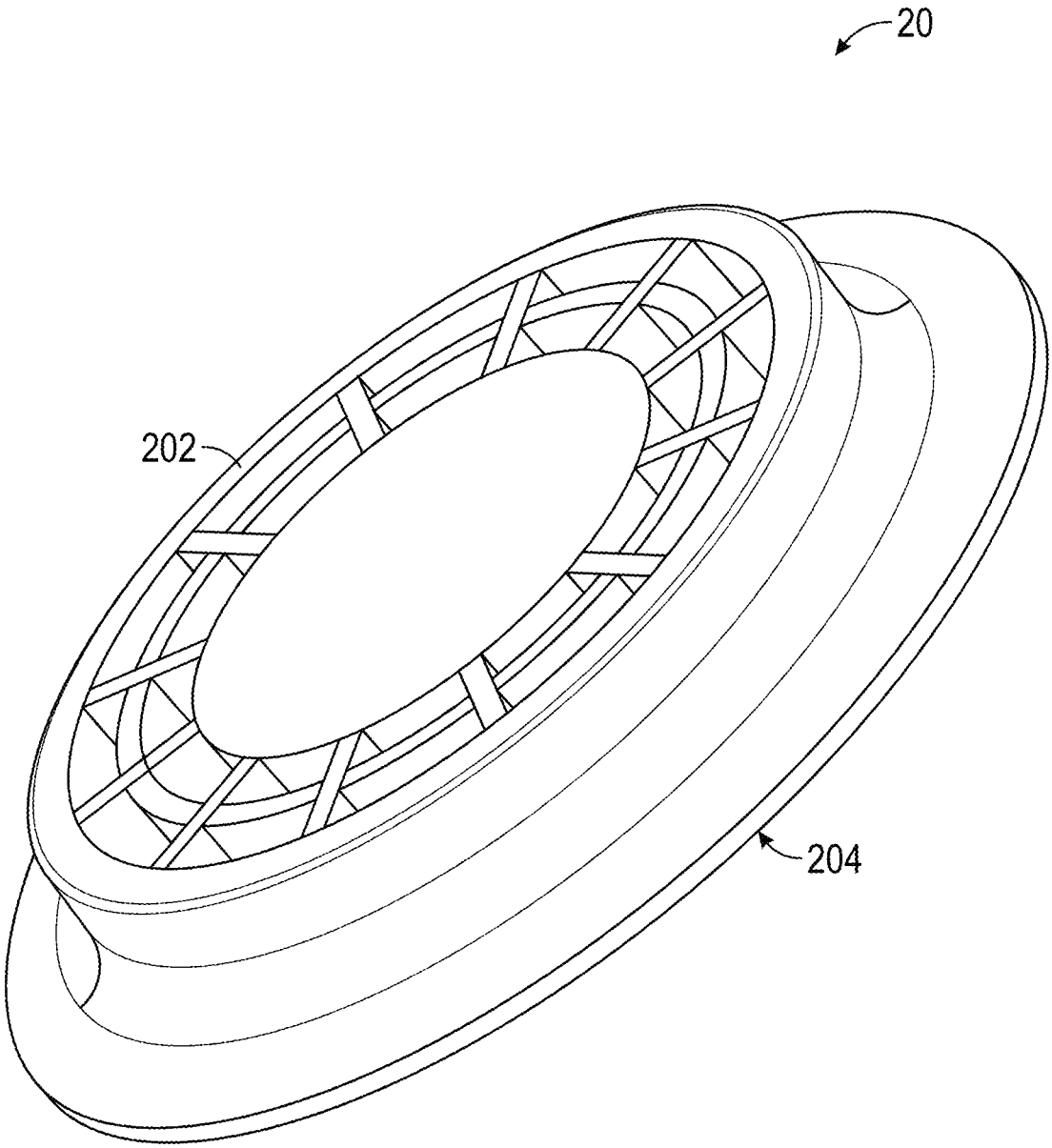
FIG. 5 illustrates the mounting assembly of the separable object holder.
Figure 6:
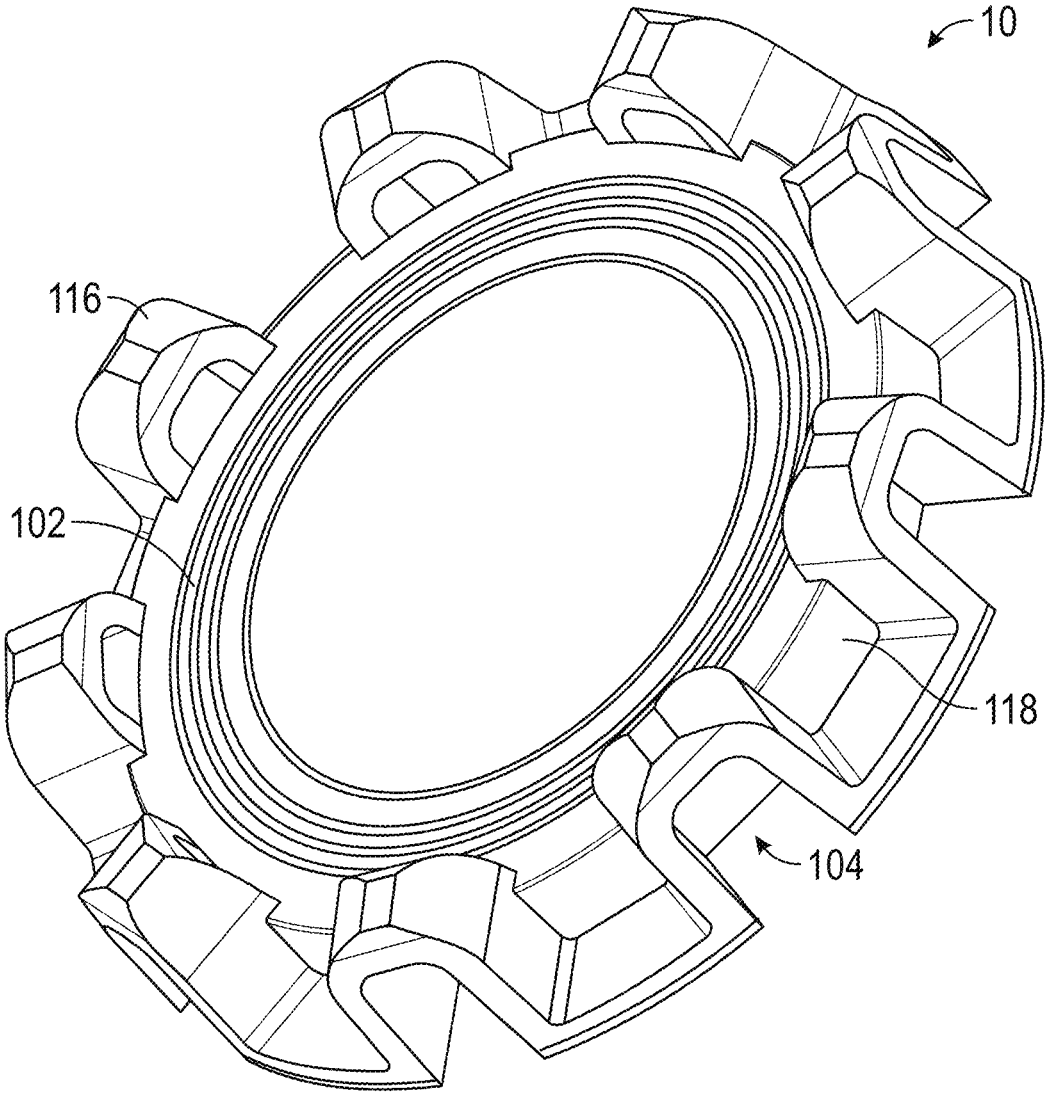
FIG. 6 illustrates the base assembly of the separable object holder.
Figure 7:
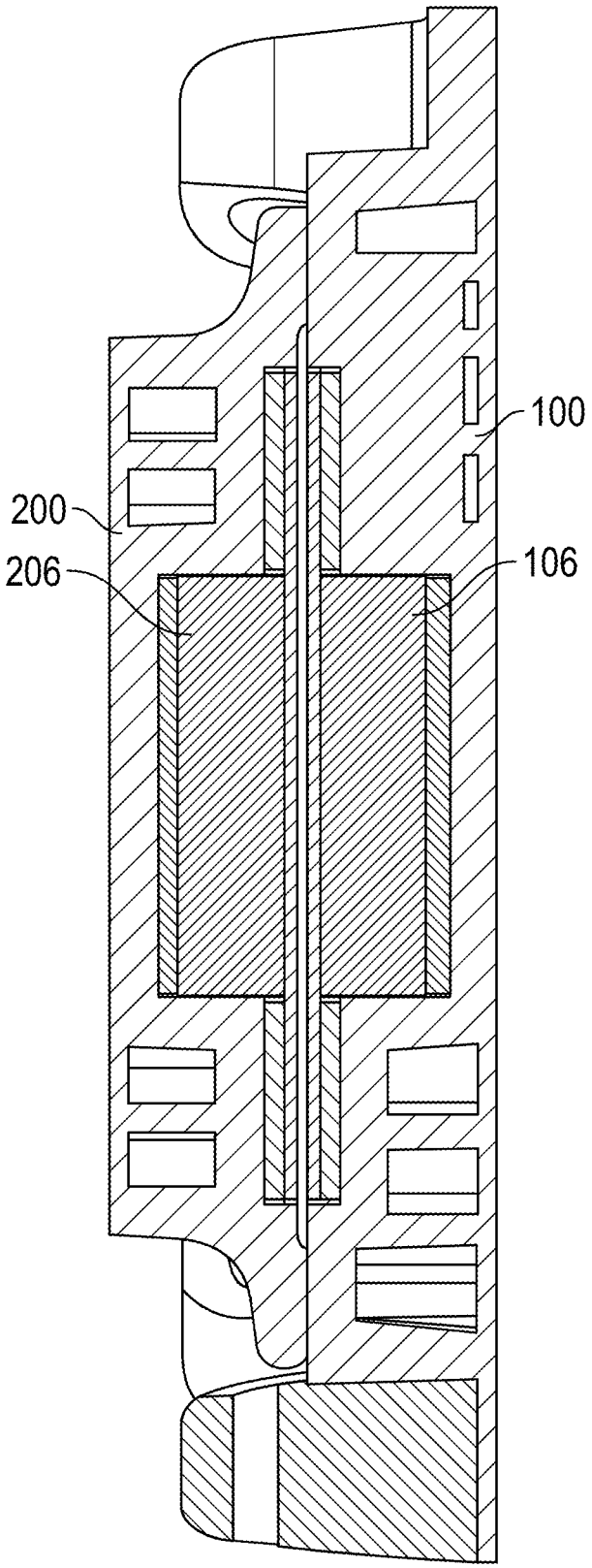
FIG. 7 is a cross-sectional view of the separable object holder in a united configuration.
Figure 8:
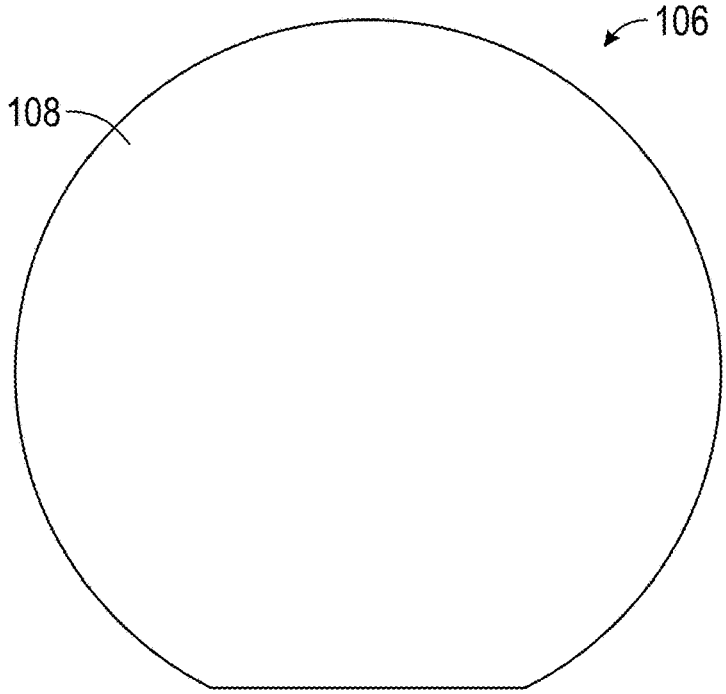
FIG. 8 illustrates one of the magnets of the separable object holder.
Figure 9:
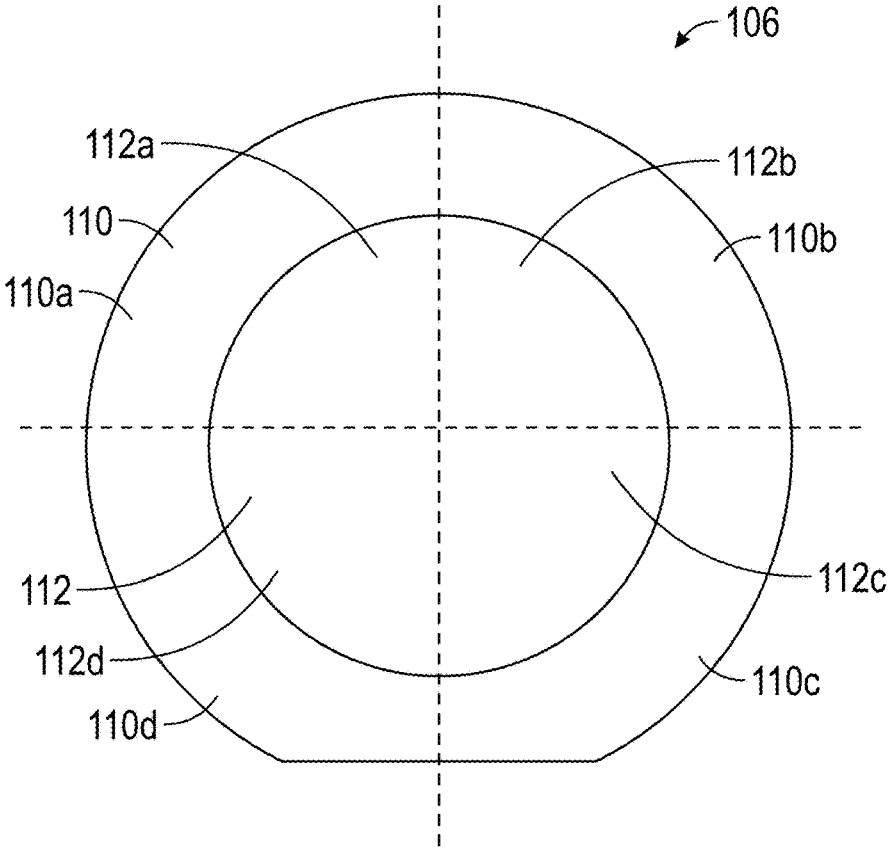
FIG. 9 illustrates a first embodiment of the configuration of the polarity pattern of the magnet.

FIGS. 1 to 11 illustrate a separable object holder 1 for affixing to a surface and holding a.

The separable object holder 1 includes a base assembly 10 that attaches to a surface and a mounting assembly 20 that attaches to an object to be held in a position or orientation by the separable object holder 1. The mounting assembly 20 magnetically connects to the base assembly 10 so that the object attached thereto will be held in a fixed position relative to the base assembly 10 to prevent the object being knocked over.

The base assembly 10 includes a base body 100 having a first surface 102, a second surface 104 configured to attach to a surface, and a base magnet 106 located in the base body 100.

The second surface 104 may be configured to attach to the surface by way of an adhesive applied to the second surface 104.

The mounting assembly 20 includes a mounting body 200 having a first surface 202 configured to attach to an object and a second surface 204 configured to abut the first surface 102 of the base assembly 10, and a mounting assembly magnet 206 located therein.

In some particular embodiments, the first surface 102 and/or the second surface 204 may include a recessed portion of any shape. Accordingly, the first surface 102 of the base assembly 10 and the second surface 204 of the mounting assembly 20 only abut about or adjacent to a respective perimeter of each of the first surface 102 and the second surface 204. This reduces friction between the mounting assembly 20 and the base assembly 10 which increases ease of use when separating the two components but also reduces wear and tear on the two surfaces from repeated rotation.

As shown in the illustrated embodiments, the first surface 102 of the base body 100 may be made up of multiple separable components to allow construction and location of the base assembly 10 and the base magnet 106. Similarly, the second surface 204 of the mounting body 200 may be made up of multiple separable components to allow construction and location of the base assembly 20 and the base magnet 206.

The first surface 202 may be configured to attach to the object by way of an adhesive applied to the first surface 202.

The base magnet 106 and the mounting assembly magnet 206 are configured such that the mounting assembly magnet 206 magnetically repels the base magnet 106 when either the mounting assembly or base assembly is rotated relative to the other of the mounting assembly or base assembly to separate the base assembly from the mounting assembly.

In a united configuration (see FIG. 1), the base magnet 106 and the mounting assembly magnet 206 are configured such that the mounting assembly magnet 206 magnetically repels the base magnet 106 when either the mounting assembly 20 or base assembly 10 is rotated relative to the other of the mounting assembly 20 or base assembly 10 by up to approximately 90°. The united configuration is provided when the mounting assembly magnet 206 and the base magnet 106 exhibit magnetic attraction that unites the mounting assembly 20 and the base assembly 10 and, in particular embodiments, causes the base body 100 to abut the mounting body 200.

Turning to the magnets, a face 108, 208 of each of the base magnet 106 and the mounting assembly magnet 206 is configured with a polarity pattern 300 which enables the specific magnetic attraction and repulsion described herein.

The polarity pattern 300 includes alternating polarity portions about the face 108, 208 of each respective magnet 106, 206 to allow the mounting assembly magnet 206 to magnetically engage with (i.e., attract) the base magnet 106 to hold the mounting assembly 20 in a fixed position relative to the base assembly 10 in a united configuration.

Additionally or alternatively, the face 108, 208 of each of the base magnet 106 and the mounting assembly 206 is configured with the polarity pattern 300 that enables magnetic attraction between the face 108 of the base magnet 106 when in direct opposition with the face 208 of the mounting assembly magnet 206 when either of the base magnet 106 or the mounting assembly magnet 206 is rotated between 0 and 90 degrees about an axis A-A extending through a centre of both the mounting assembly magnet 206 and the base magnet 106 to hold the mounting assembly 20 in a fixed position relative to the base assembly 10.

Furthermore, the polarity pattern 300 enables magnetic repulsion between the face 108 of the base magnet 106 in direct opposition with the face 208 of the mounting assembly magnet 206 when the first surface 102 of the base assembly 10 is in abutment with the second surface 204 of the mounting assembly 20 and either of the base magnet 106 or the mounting assembly magnet 206 is rotated approximately 90 degrees about the axis A-A extending through a centre of both the mounting assembly magnet 206 and the base magnet 106 to thereby separate the mounting assembly 20 from the base assembly 10.

The above allows the base assembly 10 and mounting assembly 20 to be easily engaged and disengaged through a twisting action.

The base magnet 106 and the mounting assembly magnet 206 are programmable magnets (or poly magnets) with identical polarity patterns. The mounting assembly magnet 206 is configured the same as the base magnet 106 as described herein.

The base magnet 106 and the mounting assembly magnet 206 are configured such that the magnetic fields only extend approximately 4 mm from each magnet. This helps to prevent the magnets 106, 206 from interfering with equipment that is sensitive to magnetic fields (for example, some electronic devices) but also reduces the risk of injury (such as fingers caught between the base assembly 10 and the mounting assembly 20) caused by strong magnetic fields that cause the two bodies to suddenly be attracted.

The base magnet 106 and the mounting assembly magnet 206 are substantially cylindrical with circular faces. In the illustrated embodiment, the base magnet 106 and the mounting assembly magnet 206 are cylindrical with circular faces having a segment removed from each face.

The ratio of the diameter of the base magnet 106 to the diameter of the base assembly 10 is between approximately 1:2.5 and 1:3. The ratio of the diameter of the mounting assembly magnet 206 to the diameter of the mounting assembly 20 is between approximately 1:2.5 and 1:3. This ratio allows for easier mechanical leverage and separation by rotation of the base assembly 10 and mounting assembly 20.

The base magnet 106 includes a substantially annular portion 110 and a circular portion 112 surrounded by the annular portion 110.

The annular portion 110 of the base magnet 106 includes four substantially equal sub-portions, wherein each of the sub-portions 110*a-d* has a polarity opposite to an adjacent sub-portion of the annular portion 110.

The circular portion 112 of the base magnet 106 includes four quadrants 112*a-d*, wherein each of the quadrants 112*a-d* is predominantly a first polarity (but may include a second polarity with one predominant polarity from the first and second polarities) and wherein each of the quadrants 112*a-d* has a polarity opposite to an adjacent sub-portion 110*a-d* of the annular portion 10 where the quadrant meets the respective sub-portion.

Figure 10:
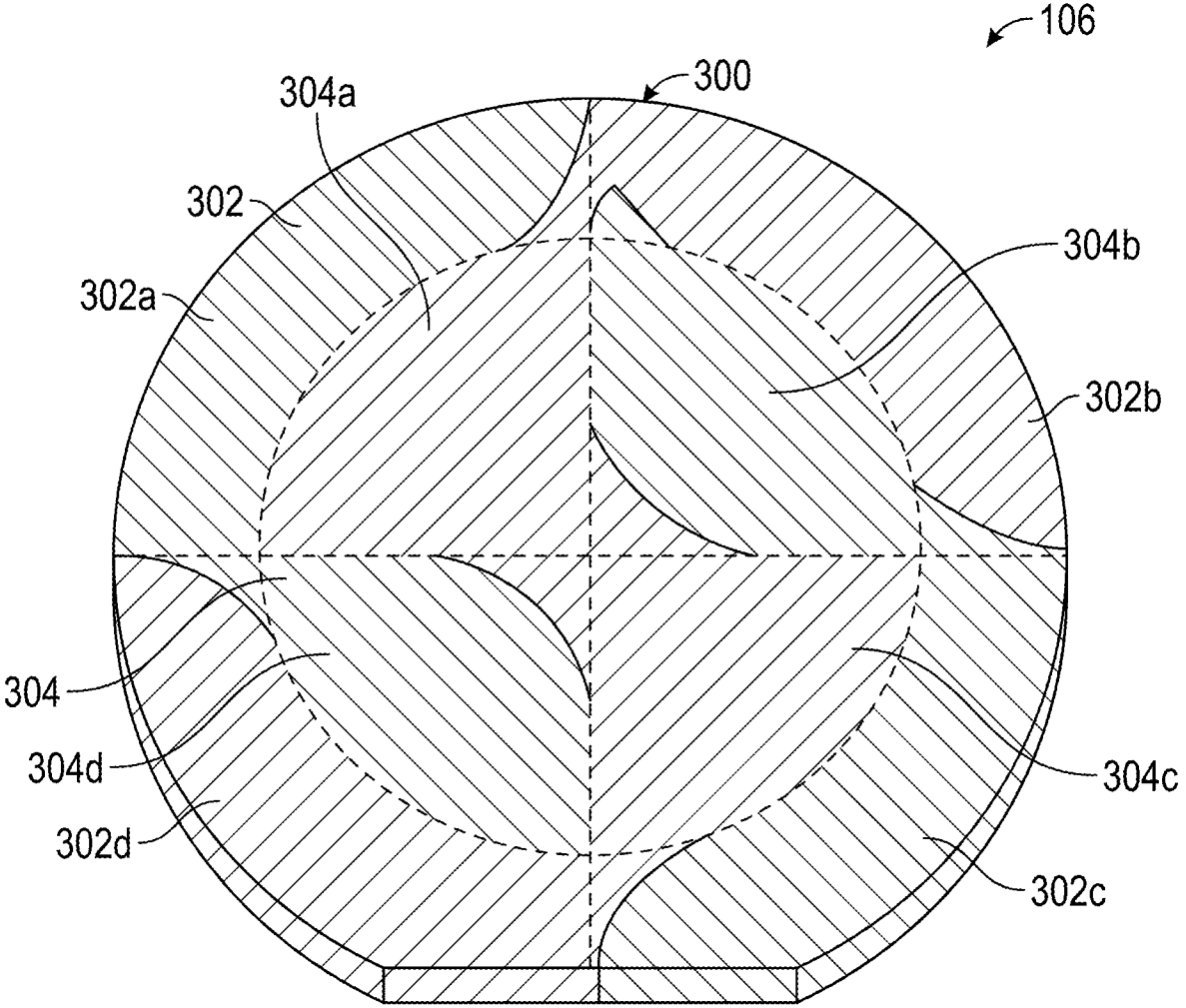
FIG. 10 illustrates an additional or alternative embodiment of the configuration of the polarity pattern of the magnet.
Figure 11:
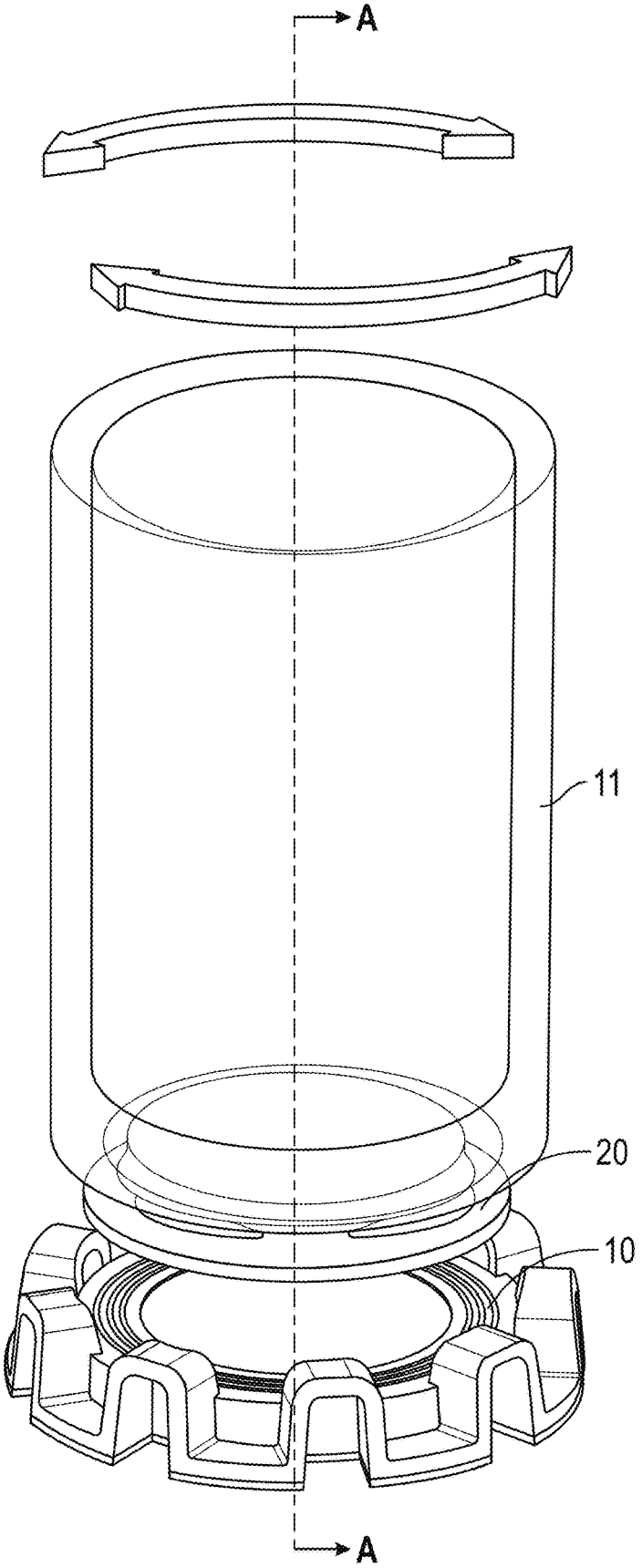
FIG. 11 illustrates the separable object holder in use with a cup.

Put another way, with reference to FIG. 10, the polarity pattern 300 of the base magnet 106 comprises a first polarity pattern 302 and a second polarity pattern 304, wherein the first polarity pattern 302 is substantially annular and the second polarity pattern 304 is substantially circular and is surrounded by the first polarity pattern 302.

The first polarity pattern 302 comprises four substantially equal sub-portions 302*a-d* arranged in an alternating polarity sequence.

The second polarity pattern 304 comprises four quadrants 304*a-d* arranged in an alternating polarity sequence, wherein a polarity of a sub-portion 302*a-d* of the annular first polarity pattern 302 is adjacent a quadrant 304*a-d* of the circular second polarity pattern 304 having an opposite polarity.

The polarity of each quadrant 304*a-d* is predominantly a first polarity and may include a second polarity with one predominant polarity from the first and second polarities.

The base assembly 10 also includes an alignment arrangement 114 for assisting with aligning the mounting assembly 20 with the base assembly 10 to induce magnetic engagement between the respective mounting assembly magnet 206 and base magnet 106.

In some embodiments, the base assembly 10 includes a plurality of projecting elements 116 connected to the base body 100.

The plurality of projecting elements 116 may be connected to and project from the first surface 102 of the base assembly 10.

In the illustrated embodiment, the alignment arrangement 114 includes a plurality of projecting elements 116 connected to a surface 118 of the base body 100 between the first surface 102 and the second surface 104, wherein the projecting elements 116 extend beyond the first surface 102 in a direction parallel to a longitudinal axis of the base body 100. The projecting elements 116 extend about the surface 118 in an undulating arrangement such that there is a space between adjacent elements.

The projecting elements 116 may also include apertures formed therein (as shown). The apertures may be formed in a face on the projecting elements 116 adjacent the first surface 102 and extend through to a directly opposing face of the projecting element 116. This allows for drainage of any liquids from the first surface 104 that may collect.

The alignment arrangement 114 also assists the user in separating the mounting assembly 20 from the base assembly 10. In particular, the projecting elements 116 provide fingerholds that a user can grip to make the rotating of the two bodies easier.

In use, an object can be secured in an orientation and/or position by the separable object holder 1. This is achieved by attaching the second surface 104 of the base assembly 10 to a surface and suitably a substantially flat surface, such as on a boat, in a vehicle or on a desk or bench.

An object, such as a cup, bottle or similar, is also attached to the first surface 202 of the mounting assembly 20. A cup 11 is outlined in FIG. 11.

To achieve the united configuration, the mounting assembly magnet 206 is then magnetically engaged with the base magnet 106 to hold the mounting assembly 20 in a fixed position 10 relative to the base assembly 20.

As set out above, this is preferably achieved by locating the face 108 of the base magnet 106 in direct opposition with the face 208 of the mounting assembly magnet 206 and rotating either the base assembly 10 or the mounting assembly 20 between 0 and 90 degrees about the axis A-A extending through the centre of both the mounting assembly magnet 206 and the base magnet 106 when to hold the mounting assembly 20 in a fixed position relative to the base assembly 10.

The base body 100 is illustrated as being substantially cylindrical and having circular surfaces at opposed ends. However, the base body may be any shape, including square, rectangular or triangular, for example.

The mounting body 20 is illustrated as having a circular base face and a circular top face that is wider or has a greater radius than the circular base face. However, the shape of the mounting body can also be any shape.

In the illustrations, the diameter or width (for non-circular embodiments) of the circular base face is approximately the same as the diameter or width (for non-circular embodiments) of the first surface 102 of the base body 100 but the diameter of the circular base face may be different to the diameter or width of the first surface 102 of the base body 100.

The mounting body must be shaped, sized and dimensioned that a surface can abut a surface of the base body to allow the two to magnetically engage and allow for relative rotation when magnetically engaged but they can otherwise be similar or differently shaped to each other.

In some embodiments, there is provided an elongate member having a spiked or pointed end and an opposed flat end that can attach to the base body. This can be used at the beach to prevent the beverageware-insulated cup/cooler or electronic device to stay out of the sand to allow the ability to sit at the water's edge with drinkware preventing sand ingress or water to splash into the beverage. This embodiment can also be used to have the object holder sit elevated above the ground, when fishing from a bank or shore, for example. In some embodiments, the elongate member and the base body are integrally formed.

In some embodiments, there is provided an extension member having a cylindrical body and two opposed flat surfaces (a first surface and a second surface). The first surface of the extension member is configured to attach to the base body and the cylindrical body being insertable into a cup holder of a vehicle, for example, to keep a coffee secure and safe. In some embodiments, the extension member and the base body are integrally formed.

In some embodiments, a flotation device is provided and is configured to attach to the base body to allow the object holder to be used in a swimming pool or in the ocean, for example. In some embodiments, the flotation device and the base body are integrally formed.

In some embodiments, a tray having a planar base that is attachable to the mounting body is provided. The tray allows for the carrying of multiple drinks and/or food to provide stability. In some embodiments, the tray is integrally formed with the mounting body.

In some embodiments, an attachment arrangement is provided and is attachable to the base body. The attachment arrangement is configured to connect to a cylindrical-shaped handle, such as on a pram or wheelchair, to allow drinks and/or electronic devices to be connected to the handle. In some embodiments, the attachment arrangement is integrally formed with the base body.

In some embodiments, a hub that enables multiple devices or connections to a computer is provided. The hub and base assembly are configured to releasably attach to each other. For example, using an adhesive double-sided tape. The hub may include a number of connections and hardware interfaces, such as headphone and microphone port/jacks, USB ports and HDMI ports, for example. A base of the hub may also be configured to attach to a surface, such as a desk or similar. The hub may also include one or more lighting elements. In some particular embodiments, the hub and base body may be integrally formed to provide a single device that can secure a cup or electronic device via the mounting assembly and provide interconnectability for a computer.

In compliance with the statute, the invention has been described in language more or less specific to structural or methodical features.

The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

The invention claimed is:

1. A separable object holder comprising:

a base assembly including a base body having a first surface, a second surface configured to attach to a surface, and a base magnet located in the base body; and a mounting assembly including a mounting body having a first surface configured to attach to an object and a second surface configured to abut the first surface of the base assembly, and a mounting assembly magnet located therein, wherein, in a united configuration, the base magnet and the mounting assembly magnet are configured such that the mounting assembly magnet magnetically repels the base magnet when either the mounting assembly or base assembly is rotated relative to the other of the mounting assembly or base assembly by up to approximately 90°, wherein the base magnet comprises a substantially annular portion and a circular portion surrounded by the substantially annular portion, and, wherein the circular portion comprises four quadrants, wherein each of the quadrants is predominantly a first polarity and wherein each of the quadrants has a polarity opposite to an adjacent sub-portion of the substantially annular portion where the quadrant meets the sub-portion of the substantially annular portion.

2. The separable object holder of claim 1, wherein a face of each of the base magnet and the mounting assembly magnet is configured with a polarity pattern including alternating polarity portions about face of the respective magnet to allow the mounting assembly magnet to magnetically attract the base magnet to hold the mounting assembly in a fixed position relative to the base assembly.

3. The separable object holder of claim 1, wherein a face of each of the base magnet and the mounting assembly is configured with a polarity pattern enabling magnetic attraction between the face of the base magnet in direct opposition with the face of the mounting assembly magnet when either of the base magnet or the mounting assembly magnet is rotated between 0 and 90 degrees about an axis extending through a centre of both the mounting assembly magnet and the base magnet to hold the mounting assembly in a fixed position relative to the base assembly.

4. The separable object holder of claim 3, wherein a face of each of the base magnet and the mounting assembly is configured with a polarity pattern enabling magnetic repulsion between the face of the base magnet in direct opposition with the face of the mounting assembly magnet when the first surface of the base assembly is in abutment with the second surface of the mounting assembly in the united configuration and either of the base magnet or the mounting assembly magnet is rotated approximately 90 degrees about an axis extending through a centre of both the mounting assembly magnet and the base magnet to thereby separate the mounting assembly from the base assembly.

5. The separable object holder of claim 1, wherein the base magnet and the mounting assembly magnet are programmable magnets.

6. The separable object holder of claim 1, wherein the base assembly includes an alignment arrangement for assisting with aligning the mounting assembly with the base assembly to induce magnetic engagement between the respective mounting assembly magnet and base magnet.

7. The separable object holder of claim 6, wherein the alignment arrangement includes a plurality of projections connected to a surface of the base assembly between the first surface and the second surface, wherein projecting elements extend beyond the first surface in a direction parallel to a longitudinal axis of the base assembly.

8. The separable object holder of claim 1, wherein the base assembly includes a plurality of projecting elements connected to and projecting from the first surface of the base assembly.

9. The separable object holder of claim 1, wherein the polarity pattern of the base magnet comprises a first polarity pattern and a second polarity pattern, wherein the first polarity pattern is substantially annular and the second polarity pattern is substantially circular and is surrounded by the first polarity pattern.

10. The separable object holder of claim 9, wherein the first polarity pattern comprises four substantially equal sub-portions arranged in an alternating polarity sequence.

11. The separable object holder of claim 10, wherein the second polarity pattern comprises four quadrants arranged in an alternating polarity sequence, wherein a polarity of a sub-portion of the annular first polarity pattern is adjacent a quadrant of the circular second polarity pattern having an opposite polarity.

12. The separable object holder of claim 11, wherein the polarity of each quadrant is predominantly a first polarity and may include a second polarity with one predominant polarity from the first and second polarities.

13. The separable object holder of claim 1, wherein the substantially annular portion comprises four substantially equal sub-portions, wherein each of the sub-portions has a polarity opposite to an adjacent sub-portion of the substantially annular portion.

14. A method of securing an object with a separable object holder, the method comprising:

providing a base assembly including a base body having a first surface, a second surface configured to attach to a surface, and a base magnet located in the base body, wherein the base magnet comprises a substantially annular portion and a circular portion surrounded by the substantially annular portion, and wherein the circular portion comprises four quadrants, wherein each of the quadrants is predominantly a first polarity and wherein each of the quadrants has a polarity opposite to an adjacent sub-portion of the substantially annular portion where the quadrant meets the sub-portion of the substantially annular portion;

providing a mounting assembly including a mounting body having a first surface configured to attach to an object and a second surface configured to abut the first surface of the base assembly, and a mounting assembly magnet located therein;

attaching the second surface of the base assembly to a surface;

attaching an object to the first surface of the mounting assembly;

magnetically engaging the mounting assembly magnet with the base magnet such that the mounting assembly magnet is magnetically attracting the base magnet to hold the mounting assembly in a fixed position relative to the base assembly to configure the base assembly and the mounting assembly in a united configuration; and rotating either the mounting assembly or base assembly relative to the other of the mounting assembly or base assembly by up to approximately 90° to magnetically repel the mounting assembly magnet away from the base magnet and separate the mounting assembly from the base assembly.

15. The method of claim 14, wherein a face of each of the base magnet and the mounting assembly being configured with a polarity pattern enabling magnetic engagement between the face of the base magnet in direct opposition with the face of the mounting assembly magnet when either of the base magnet or the mounting assembly magnet is rotated between 0 and 90 degrees about an axis extending through a centre of both the mounting assembly magnet and the base magnet when to hold the mounting assembly in a fixed position relative to the base assembly;

and the method further comprises:

arranging the face of the mounting assembly magnet in direct opposition with the base magnet; and rotating the mounting assembly or the base assembly between 0 and 90 degrees about the axis extending through the centre of both the mounting assembly magnet and the base magnet to magnetically engage the mounting assembly magnet with the base magnet to hold the mounting assembly in a fixed position relative to the base assembly.

16. The method of claim 14, wherein a face of each of the base magnet and the mounting assembly magnet is configured with a polarity pattern including alternating polarity portions about an edge of the respective magnet to allow the mounting assembly magnet to magnetically engage with the base magnet to hold the mounting assembly in a fixed position relative to the base assembly;

and the method further comprises:

arranging the face of the mounting assembly magnet in direct opposition with the base magnet; and magnetically engaging the mounting assembly magnet with the base magnet to hold the mounting assembly in a fixed position relative to the base assembly.

17. A separable object holder comprising:

a base assembly including a base body having a first surface, a second surface configured to attach to a surface, and a base magnet located in the base body; and a mounting assembly including a mounting body having a first surface configured to attach to an object and a second surface configured to abut the first surface of the base assembly, and a mounting assembly magnet located therein, wherein the base magnet and the mounting assembly magnet are configured such that the mounting assembly magnet magnetically repels the base magnet when either the mounting assembly or base assembly is rotated relative to the other of the mounting assembly or base assembly to separate the base assembly from the mounting assembly, wherein the base magnet comprises a substantially annular portion and a circular portion surrounded by the substantially annular portion, and, wherein the circular portion comprises four quadrants, wherein each of the quadrants is predominantly a first polarity and wherein each of the quadrants has a polarity opposite to an adjacent sub-portion of the substantially annular portion where the quadrant meets the sub-portion of the substantially annular portion.

* * * * *